US005326303A

United States Patent [19]

D'Andrade

[11] Patent Number: 5,326,303

[45] Date of Patent: Jul. 5, 1994

[54] RIFLE WITH REALISTIC COCKING AND FIRING SOUND

[76] Inventor: Bruce M. D'Andrade, 3 Ten Eyck Rd., Whitehouse Station, N.J. 08889

[21] Appl. No.: 898,131

[22] Filed: Jun. 15, 1992

[51] Int. Cl.[5] ..... A63H 5/04

[52] U.S. Cl. ..... 446/407; 446/473

[58] Field of Search ..... 446/407, 406, 405, 473

[56] References Cited

U.S. PATENT DOCUMENTS

| | | | |
|---|---|---|---|
| 2,741,872 | 4/1956 | Sigg . | |
| 2,770,916 | 11/1956 | Sigg . | |
| 2,989,820 | 6/1961 | Leclerc | 446/407 |
| 3,420,530 | 1/1969 | Ryan et al. | 446/407 X |
| 4,114,311 | 9/1978 | Chow . | |
| 4,175,353 | 11/1979 | Pickett . | |
| 4,365,439 | 12/1982 | Litynski | 446/406 |
| 4,750,641 | 6/1988 | Chin-Fu | 446/406 X |
| 4,808,143 | 2/1989 | Kuo | 446/406 |

*Primary Examiner*—Mickey Yu

*Attorney, Agent, or Firm*—Kenneth P. Glynn; Stephen J. Driscoll

[57] ABSTRACT

The present invention is a toy gun which has a housing with a main section and a handle, a barrel, a trigger, a swivel cocking mechanism, a battery holder, electrical connections, a printed circuit board, a sound amplifier/-speaker, and activation mechanism with springs, and sufficient circuitry to generate realistic cocking sounds and separate realistic firing sounds of a fired gun. The trigger has a finger portion below the pivot point and an engaging portion above the pivot point and is biased to a first position, e.g. via a spring, and, when the trigger is pulled, moves to a second position. The swivel cocking mechanism, attached to the housing, has a closed position and an open position. It is connected to an activation mechanism which has two positions corresponding thereto. The battery holder has connections for one or more batteries and the printed circuit board and sound amplifier/speaker have electrical connections to the battery holder and the speaker with breaks in the electrical connection near the engaging portion of the trigger and near the activation mechanism's first position and second position. When the trigger is in its first position the electrical connection for firing sound is incomplete and when the trigger is pulled, it is complete. The connections near the activation mechanism is brought to its open position and again when it is being closed, to set off cocking mechanism is brought to its open position and again when it is being closed, to set off cocking sounds.

16 Claims, 2 Drawing Sheets

RIFLE WITH REALISTIC COCKING AND FIRING SOUND

BACKGROUND OF THE INVENTION

1. Field of the Invention

The present invention involves a toy gun which has been developed to create realistic gun action, including the actual sound of cocking a gun and firing it. More specifically, the present invention is directed to a toy gun which utilizes electrical components as well as mechanical means to create these effects.

2. Prior Art Statement

Numerous patents have issued over the years to toy inventors which cover toy guns which create different types of effects. The following prior art patents illustrate the development of this art:

U.S. Pat. No. 2,770,916, issued to Joseph Sigg describes a trigger mechanism for toy guns which utilizes a trigger and spring arrangement to cause a barrel and a fin-like portion to reciprocate. However, the fin-like member and barrel can only create the sound of their materials of construction and not the realistic sound of the present invention, nor is there any direct relationship between a swivel cocking mechanism and an electronic sounding mechanism such as in the present invention.

U.S. Pat. No. 2,741,872, also issued to Joseph Sigg, describes a multiple action toy gun which is indicated to be a space gun in which the ray ejector barrel is subject to rapid oscillatory movement in the gun stock by means of a cam actuated retractor mechanism. The actuator mechanism employs a resilient means for effecting oscillatory movement of the ray barrel complimented by sound which is resiliently mounted in the stock of the gun to assume a forward position from which it is displaced by a cam actuator retractor mechanism. It relies primarily on saw teeth and a trigger with a pawl whereby a single retractor stroke will cause repeated motion. Again, this patent does not teach the use of a circuit board to generate sound nor does it have the activating mechanism which is a critical feature of the present invention.

U.S. Pat. No. 4,808,143 issued to Yi Kuo describes a toy machine gun which has a trigger associated with a micro switch. The micro switch engages a rotatable wheel through a reduction gear. A link assembly together with the rotatable wheel provides a reciprocating motion and creates a kick-back. In addition, the link assembly is arranged to actuate another micro switch which controls an audio circuit board and a speaker for generating a sound mimicking a gun shot. In this particular invention, there is no cocking mechanism and no activation mechanisms associated with the sounding for cocking and for firing of the toy gun of the type utilized in the present invention. Further, the type of repeated reciprocal motion of this prior art is not utilized in the present invention and this device achieves a different result using different means.

U.S. Pat. No. 4,750,641, issued to Hun Chin Fu describes a continuous water ejecting pistol with a simultaneous sound and red flashing effect. Again, this toy gun does not employ the activating mechanisms and cocking mechanism for the connected sounding system as in the present invention.

U.S. Pat. No. 4,365,439, issued to Zbigniew Litynski, describes a toy laser-type gun which incorporates light and sound sources for simultaneous generation of light pulses and sounds reminiscent of an outer space laser gun when a trigger is depressed. One may wonder how the inventor could reminisce of outer space laser guns, but, nonetheless, this particular prior art patent employs reflectors and pulsating lights with electronic circuitry but, again, does not utilize the mechanisms or the sounding system of the present invention. U.S. Pat. No. 4,114,311 to Thomas Chow describes a toy gun having a barrel and a handle with a supporting pivoted trigger and a spring pressed hammer engagable with an elongated slide having drive teeth engagable with pinion drive means for a noise producing unit in the barrel which includes a vibratable spring that produces a sound resembling a ricocheting bullet. There is no provision for mechanisms such as in the present invention for effecting a realistic cocking sound connected to actual cocking followed by the actual sound of a shot upon firing of the gun.

U.S. Pat. No. 4,175,353 describes a toy simulated ray gun which includes controllable audio and visual effects simulating a fictitious futuristic space age weapon. It includes electronic components with power source, timer means and audio generation means so as to generate sounds with either a single shot or a continuous high pitch or a blast sound that rapidly decays when the trigger is pulled to fire the gun and to simultaneously activate the lights according to a pre-selected mode. Again, this prior art patent does not describe the cocking and firing mechanisms utilized in the present invention.

SUMMARY OF THE INVENTION

The present invention is directed to a toy gun which has a housing with a main section and a handle, a barrel, a trigger, a swivel cocking mechanism, a battery holder, electrical connections, a printed circuit board, a sound amplifier/speaker, an activation mechanism with springs, and sufficient circuitry to generate realistic cocking sounds and separate realistic firing sounds of a fired gun. The barrel is connected to the main section of the housing and the trigger is connected to the housing such that it is pivotally mounted therein. The trigger has a finger portion below the pivot point and an engaging portion above the pivot point and is biased to a first position, e.g. via a spring, and, when the trigger is pulled, moves to a second position. The swivel cocking mechanism, attached to the housing, has a closed position and an open position. It is connected to an activation mechanism which has two positions corresponding thereto. The battery holder has connections for one or more batteries and the printed circuit board and sound amplifier/speaker have electrical connections to the battery holder and the speaker with breaks in the electrical connection near the engaging portion of the trigger and near the activation mechanism's first position and second position. When the trigger is in its first position the electrical connection for firing sound is incomplete and when the trigger is pulled, it is complete. Likewise, the connections near the activation mechanism are only completed when the swivel cocking mechanism is brought to its open position and again when it is being closed, to set off cocking sounds.

BRIEF DESCRIPTION OF THE DRAWINGS

The present invention will be more fully understood when the specification herein is taken in conjunction with the appended drawings, wherein.

DETAILED DESCRIPTION OF THE PRESENT INVENTION

The present invention involves a toy gun which will typically take the form of a rifle, but may have a housing of other types of elongated guns, e.g. large pistol, bazooka, space gun, or the like. However, the present invention does specifically involve toy guns which have a movable swivel cocking slider located on the main portions of the toy gun itself. Specifically, there is a housing and a barrel connected to the housing and the housing includes a main portion and a handle. The critical features of the present invention include a cocking mechanism coupled with a realistic sound of cocking, e.g. one or two clicks, as well as a trigger and a realistic sound of firing a gun. Additional features in preferred embodiments include the cocking of the gun being tied into the setting of the firing hammer and its subsequent release upon pulling of the trigger in combination with realistic cocking sounds and firing sounds.

Figure 1:
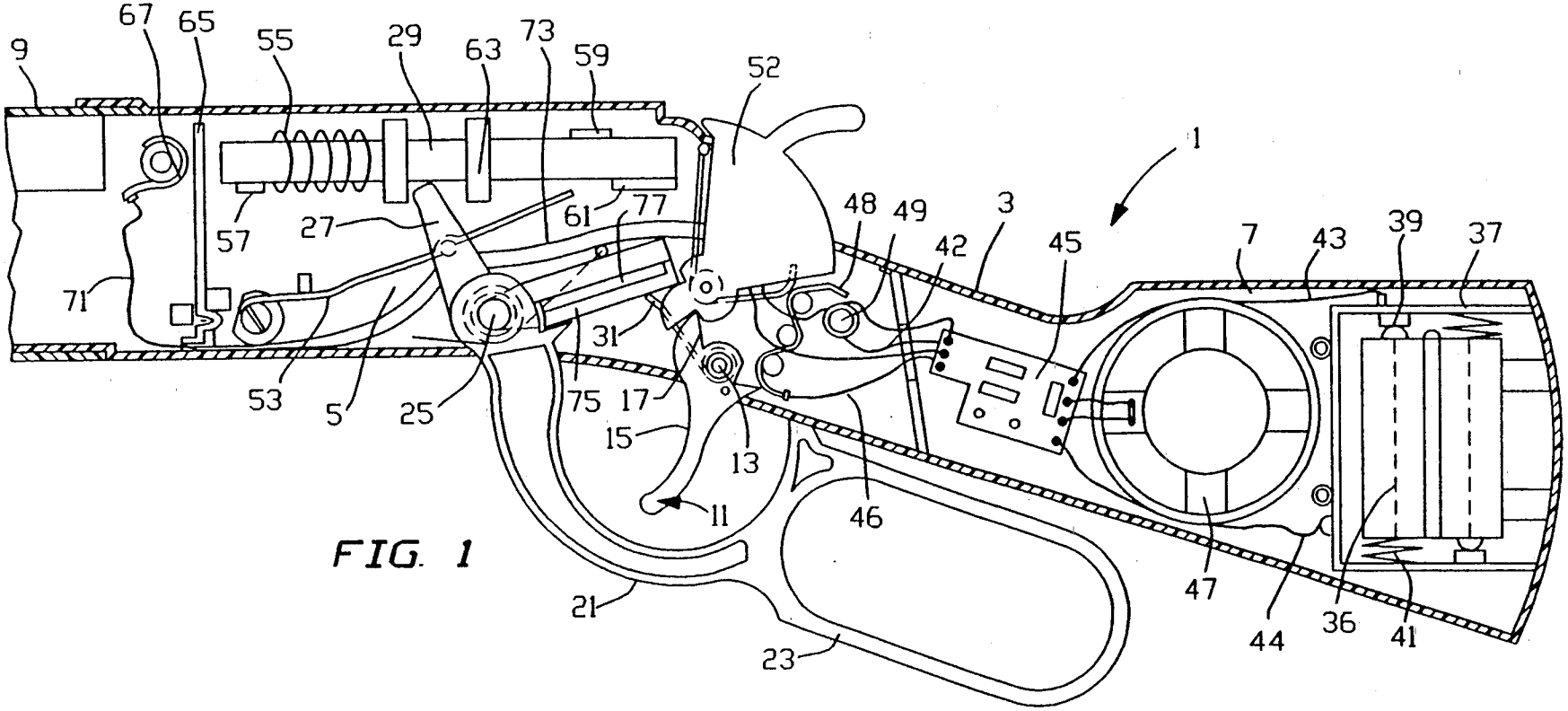
FIG. 1 shows a side, cut view of one embodiment of the present invention toy gun; and, FIG. 2 shows a blown up section of the present invention toy gun shown in FIG. 1.
Figure 2:
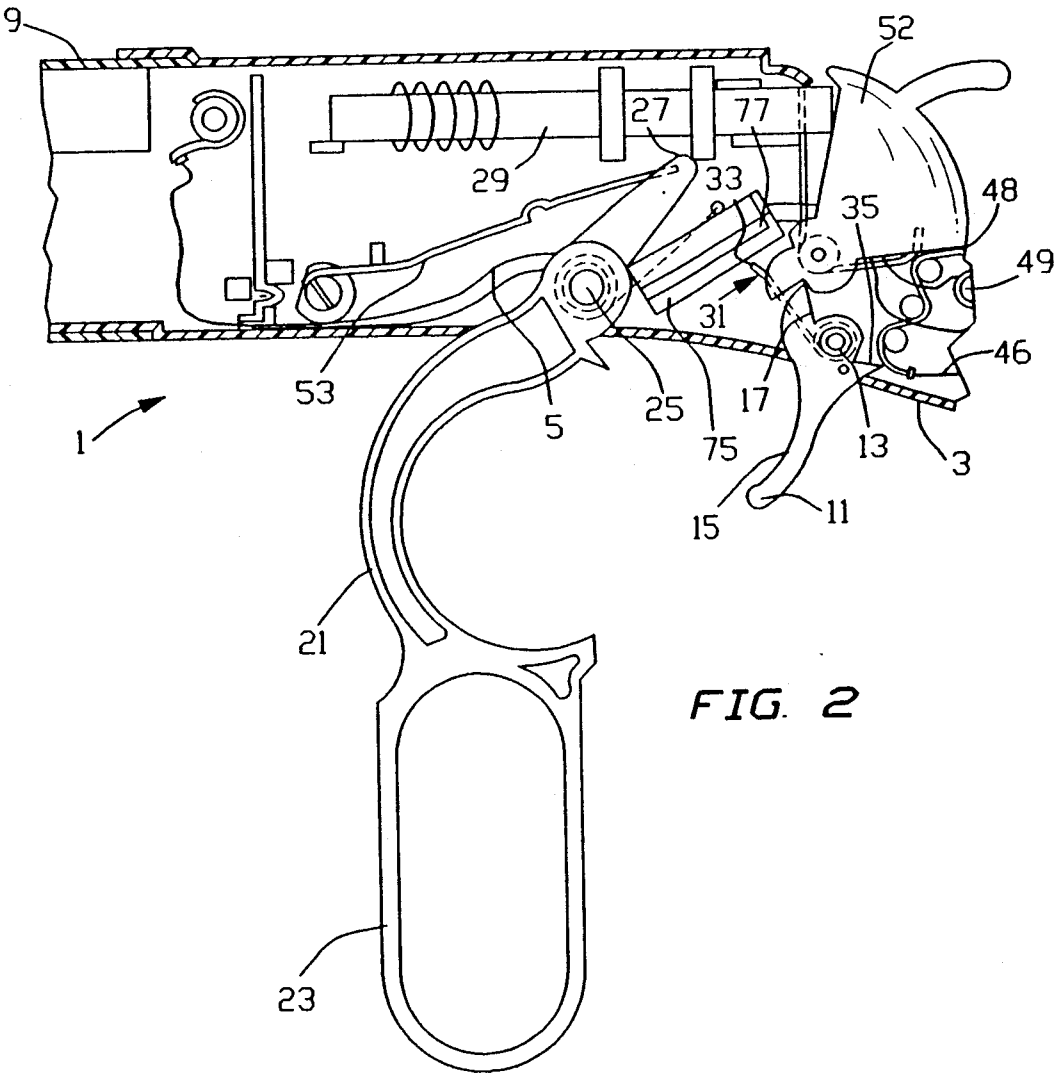

Referring now to FIGS. 1 and 2, there is shown present invention toy gun rifle 1, having housing 3 with a main section 5 and a butt 7. There is also included a barrel 9 (shown in part) connected to and extending from main section 5 of housing 3. A trigger 11 is connected to housing 3 and is pivotally mounted therein. In this embodiment there is a pivot point 13 and the trigger has a finger portion 15 located below the pivot point 13 and also has an engaging portion 17 located beyond pivot point 13. The finger portion 15 is located outside of housing 3 and the engaging portion 17 is located within housing 3. Also shown is swivel cocking mechanism 21 with handle 23 and pivot point 25, as shown. Arm 27 extends from pivot point 25 and acts in conjunction with activation mechanism 29.

The trigger 11 has biasing means 31. In this embodiment, it is a spring which is connected in a fixed position at one end 33 to housing 3 and at the other end 35, to trigger 11. It is wrapped about pivot point 13. When the trigger is in its normal, biased position, this is referred to as its first position, it is as shown in FIG. 1. When trigger 11 is pulled at its finger portion 15, finger portion 15 moves back and engaging portion 17 moves downward, to a second position. This second position causes one or more actions to occur as more fully described below.

A battery holder 37 with batteries 36 is included in the housing 3 (and in this embodiment is actually located in butt 7 of housing 3). The battery holder 37 has connections for one or more batteries as represented by connections 39 and 41. These connections are soldered contacts or springs otherwise electrically joined to electrical connections 43 and 44 which, in this case, are wires, although could be electrical paths printed within the housing or on a substrate located in the housing. Electrical connections 43 and 44 are connected to battery holder 37 for battery powering and are also connected to a printed circuit board 45 and an amplifier/speaker 47. There are electrical connections 42 and 46, with a break therein, such as here, with contact strip 48 connected to wire 46 and contact post 49 connected to wire 42. As shown in FIG. 1, contact strip 48 and contact post 49 are separated from one another. However, when swivel cocking mechanism 21 is pulled downwardly, the engaging portion arm 27 moves activation mechanism 29 to the right and pushes hammer 52 (which is spring biased) towards contact strip 48 and push contact strip 48 to contact post 49 to complete the circuitry so as to cause a realistic cocking sound to be amplified and emitted from amplifier/speaker 47.

Printed circuit board 45 has sufficient circuitry components so as to generate the aforesaid realistic cocking sound, and, in preferred embodiments, utilizes digitally converted gun cocking sound taken from the recording of the cocking of an actual gun.

As shown in FIG. 1, reciprocating slider activation mechanism 29 has a spring 55 mounted thereon and has guides 57, 59 and 61, as shown. Biasing spring 55 holds swivel cocking mechanism 21 in a position between the butt 7 and the barrel 9. When trigger 11 is pulled, hammer 52 (spring biased towards activation mechanism 29 but stopped by trigger 11 in its first position) hits activation mechanism 29, and this hits contact strip 65 which connects with contact post 67 to complete the circuit via connections 71 and 73, to printed circuit board 45. This completed circuitry results in a firing sound which is realistic and, preferrably, is based on a digitalized recording of an actual firing of a real rifle.

FIG. 2 shows a blown-up portion of FIG. 1 but with swivel cocking mechanism 21 in the downward position. Reference is now made to both Figures and like parts are like numbered. Spring 53 holds the swivel cocking mechanism 21 in its closed position but this is overcome by slight force. When swivel cocking mechanism 21 is down, as shown being moved down in FIG. 2, release bar 75 is swiveled so as to have its distal end 77 move upward by arm 27 to unlock hammer 52 for subsequent firing by pulling the trigger 11.

When trigger 11 is pulled back and its engaging portion 17 moves forward, it will not only release hammer 52 to hit activation mechanism 29 to close contact strip 65 with contact post 67 as discussed above, it will also permit the resetting of distal end 77 to its lock position, requiring recocking for firing.

When activation mechanism 29 is pulled back and released, as mentioned, a double cocking click is generated. This is optional but preferred. Further, in another preferred embodiment, one clicking sound is generated. Other sound or sounds could be generated without exceeding the scope of the invention.

As mentioned, the toy gun 1 of the present invention may take other forms without exceeding the scope of the invention. It may be a full size rifle, a double barreled rifle, a shorter rifle, a futuristic gun or otherwise. As long as it has a firing trigger, a swivel cocker and the mechanisms described above.

The toy guns of the present invention may be constructed of metal or plastic or wood, but is preferably constructed of a combination of materials which will be inexpensive to manufacture and yet durable enough to minimize failure and breakage. Further, the battery holder may be designed to handle a single battery of conventional sizes or two or three batteries, such as, for example, three 1.5 volt size AA. Additional features such as other safety locks, or other features which are found on actual guns may be included. Alternatively, if the toy gun of the present invention were to take on the form of a futuristic weapon or space gun, other sounds could be included as well, such as warning signals, and various lighting features could be include with conventional wiring to the power source and connecting this with breaks so that the trigger mechanism will complete the circuit when pulled.

Obviously, numerous modifications and variations of the present invention are possible in light of the above teachings. It is therefore understood that within the scope of the appended claims, the invention may be practiced otherwise than as specifically described herein.

What is claimed is:

1. A toy gun, which comprises;

(a) a housing having a main section and a handle;

(b) a barrel connected to and extending from said main section of said housing;

(c) a trigger connected to said housing and pivotally mounting therein, said trigger having a finger portion below a pivot point and located outside of said housing, and having an engaging portion above said pivot point and located inside of said housing and having biasing means connected thereto so as to bias said trigger to a normal, first position, and having a second position when said trigger is pulled;

(d) a battery holder and connections for one or more batteries, located within said housing;

(e) a printed circuit board and a sound amplifier/-speaker with electrical connection to said battery holder and to said sound amplifier/speaker with a break in the electrical connection operably connected, directly or indirectly, to said engaging portion of said trigger, such that when the trigger is in its first position, the electrical connection is incomplete and when pulled to its second position, the electrical connection is, either directly or indirectly, completed, said circuit board having sufficient circuitry components to recreate a realistic firing sound when said electrical connection is complete;

(f) a swivel cocking mechanism connected to said housing and pivotally mounted therein and having an open position and a closed position;

(g) cocking sound generating system including electrical connection to and from said printed circuit board, amplifier/speaker, and battery holder, with a break in said electrical connection operably connected, directly or indirectly, to said swivel cocking mechanism, such that when said swivel cocking mechanism is in its closed position, the electrical connection is incomplete and when it is in its open position, the electrical connection is complete so as to recreate a realistic cocking sound; and, (h) a hammer which creates indirect operation between said trigger and said electrical connection of said circuit board, and said hammer also creates indirect operation between said swivel cocking mechanism and said electrical connection of said cocking sound generating system.

2. The toy gun of claim 1, wherein said circuitry components include digitally converted gun firing sound from the firing of an actual gun.

3. The toy gun of claim 1, wherein said gun further includes a firing locking bar and said swivel cocking mechanism also acts in conjunction with said firing locking bar which is released upon cocking to permit firing.

4. The toy gun of claim 1, wherein said biasing means for said trigger is a spring having one end fixed to said housing and another end attached to said trigger.

5. The toy gun of claim 1, wherein said circuit board has additional electrical connections and additional circuitry components sufficient to create one or more selected, predetermined sounds in response to movement of said swivel cocking mechanism.

6. The toy gun of claim 1, wherein said circuitry components include a digitally converted gun cocking sound from the cocking of an actual gun.

7. The toy gun of claim 1, further including additional circuitry components sufficient to create a realistic cocking release click sound so that two separate clicking sounds are created when said swivel cocking mechanism is moved to its open position and then its closed position.

8. The toy gun of claim 2, wherein there are additional circuitry components sufficient to create a realistic cocking release click sound so that two separate clicking sounds are created when said swivel cocking mechanism is moved to its open position end then its closed position.

9. A toy gun, which comprises;

(a) a housing having a main section and a handle;

(b) a barrel connected to and extending from said main section of said housing;

(c) a trigger connected to said housing and pivotally mounting therein, said trigger having a finger portion below a pivot point and located outside of said housing, and having an engaging portion above said pivot point and located inside of said housing and having biasing means connected thereto so as to bias said trigger to a normal, first position, and having a second position when said trigger is pulled;

(d) a battery holder and connections for one or more batteries, located within said housing;

(e) a printed circuit board and a sound amplifier/-speaker with electrical connection to said battery holder and to said sound amplifier/speaker with a break in the electrical connection operably connected, directly or indirectly, to said engaging portion of said trigger, such that when the trigger is in its first position, the electrical connection is incomplete and when pulled to its second position, the electrical connection is, either directly or indirectly, completed, said circuit board having sufficient circuitry components to recreate a realistic firing sound when said electrical connection is complete;

(f) a swivel cocking mechanism connected to said housing and pivotally mounted therein and having an open position and a closed position;

(g) cocking sound generating system including electrical connection to and from said printed circuit board, amplifier/speaker, and battery holder, with a break in said electrical connection operably connected, directly or indirectly, to said swivel cocking mechanism, such that when said swivel cocking mechanism is in its closed position, the electrical connection is incomplete and when it is in its open position, the electrical connection is complete so as to recreate a realistic cocking sound; and, (h) additional circuitry components sufficient to create a realistic cocking release click sound so that two separate clicking sounds are created when said swivel cocking mechanism is moved to its open position and then to its closed position.

10. The toy gun of claim 9, wherein said circuitry components include digitally converted gun firing sound from the firing of an actual gun.

11. The toy gun of claim 9 which further includes a hammer which creates indirect operation between said trigger and said electrical connection of said circuit board.

12. The toy gun of claim 11 wherein said hammer also created indirect operation between said swivel cocking mechanism and said electrical connection of said cocking sound generating system.

13. The toy gun of claim 12, wherein said gun further includes a firing locking bar and said swivel cocking mechanism also acts in conjunction with said firing locking bar which is released upon cocking to permit firing.

14. The toy gun of claim 9, wherein said biasing means for said trigger is a spring having one end fixed to said housing and another end attached to said trigger.

15. The toy gun of claim 9, wherein said circuit board has additional electrical connections and additional circuitry components sufficient to create one or more selected, predetermined sounds in response to movement of said swivel cocking mechanism.

16. The toy gun of claim 9, wherein said circuitry components include a digitally converted gun cocking sound from the cocking of an actual gun.

* * * * *